United States Patent [19]

Romanelli

[11] 3,933,419

[45] Jan. 20, 1976

[54] MAGNETICALLY-CONTROLLED GAS IGNITION SYSTEM

[75] Inventor: Pat Romanelli, Harrington Park, N.J.

[73] Assignee: Ram Domestic Products Company, Northvale, N.J.

[22] Filed: Nov. 20, 1974

[21] Appl. No.: 525,397

[52] U.S. Cl. ..... 431/66

[51] Int. Cl.² ..... F23N 5/00

[58] Field of Search ..... 431/66, 67, 254

[56] References Cited

UNITED STATES PATENTS

| | | | |
|---|---|---|---|
| 2,180,675 | 11/1939 | Gille | 431/66 |
| 3,620,659 | 11/1971 | Fox | 431/66 |
| 3,871,814 | 3/1975 | Das et al. | 431/66 |

*Primary Examiner*—Edward G. Favors
*Attorney, Agent, or Firm*—Edward F. Levy

[57] ABSTRACT

An automatic gas ignition system including an electrically-energized gas ignition element in proximity to a gas burner and a magnetic heat-sensing device comprising a permanent magnet and a sensing plate having a Curie temperature at or above the ignition temperature of the gas in the system. The sensing plate is located close to the ignition element so as to be heated thereby. The magnet is attracted into contact with the sensing plate when the latter is at a temperature below its Curie temperature, and is released from the plate when the latter is heated to its Curie temperature by the ignition element. The magnet is operatively connected to a valve supplying gas to the burner in such a manner as to maintain the valve closed when the magnet is attracted to the sensing plate, and to open the valve when the magnet is released by the plate. Thus, gas is permitted to flow to the burner only when the ignition element has reached a gas ignition temperature.

9 Claims, 4 Drawing Figures

MAGNETICALLY-CONTROLLED GAS IGNITION SYSTEM

The present invention related to improvements in automatic systems for gas fired devices, and in particular to a novel and improved automatic ignition and heat detection system for gas burners.

In many conventional gas fired appliances such as automatic clothes dryers, kitchen cooking ranges and the like, it is customary to provide pilot burners for igniting the main burners when gas is supplied to the latter. These pilot burners are continually operating to provide a constant flame, and consequently result in a considerable waste of gas which is burned even when its flame is not required for operation of the appliance. In view of present-day fuel shortages, such waste of gas occasioned by the widespread use of appliances incorporating pilot burners, presents a serious problem.

It is an object of the present invention to provide an electrically operated ignition system for gas fired appliances which will replace conventional gas pilot burners.

Another object of the invention is to provide an electrically operated ignition system for gas fired appliances which includes an electrical ignition element which is energized to heat the same only when the appliance is to be brought into operation, and a novel heat-sensing gas control device which provides the safety feature of blocking flow of the gas to the burner until the ignition element has been heated to a gas-ignition temperature.

Still another object of the invention is to provide an ignition system of the character described in which the heat sensing device also functions to deenergize the ignition element after the burner has been properly fired.

A further object of the invention is the provision of an ignition system of the character described which is composed of few simple parts and is made in compact form so that it can be easily and conveniently installed in any standard gas-fired appliance which has an available source of electrical power.

In accordance with the invention there is provided an automatic fuel ignition and heat detection system for gas fired appliances having a source of electrical power, a burner and a fuel valve for controlling the flow of gas to the burner. The system comprises an electrical ignition element connected to the source of electrical power and located in proximity to the burner outlet for igniting gas flowing from the burner when the ignition element is brought to a gas ignition temperature, a heat-sensing element mounted adjacent to the ignition element in a position to receive the heat therefrom, and a permanent magnet normally attracted by the heat sensing element into engagement therewith. The heat sensing element has a Curie temperature at least as high as the gas ignition temperature, so that is loses its magnetic attractability when heated by the ignition element to the gas ignition temperature, and releases the permanent magnet. The magent is operatively connected to the fuel valve in such a manner as to maintain the fuel valve closed when the magnet is attracted into engagement with the heat sensing element, and to open the fuel valve when the magnet is released by the heated sensing element.

Additional objects and advantages of the invention will become apparent during the course of the following specification when taken in connection with the accompanying drawings, in which.

Figure 1:
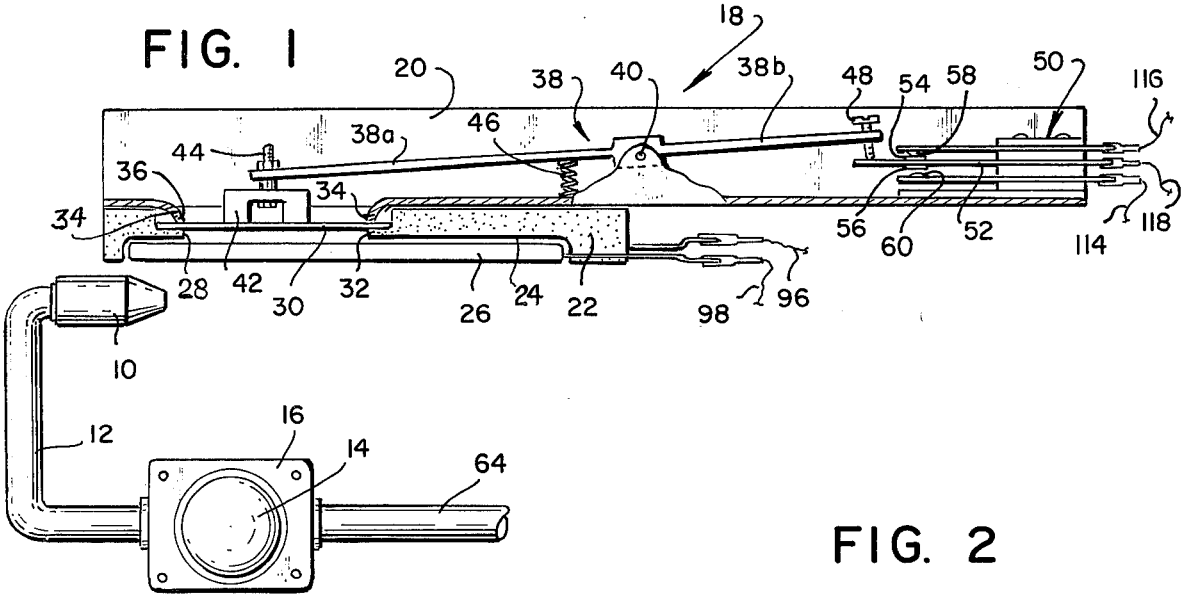
FIG. 1 is an elevation view, shown partially in section, of a gas burner installation incorporating a preferred embodiment of the automatic ignition and detection system of the present invention, the system being shown in its normal position in which the gas supply to the burner is shut off.
Figure 2:
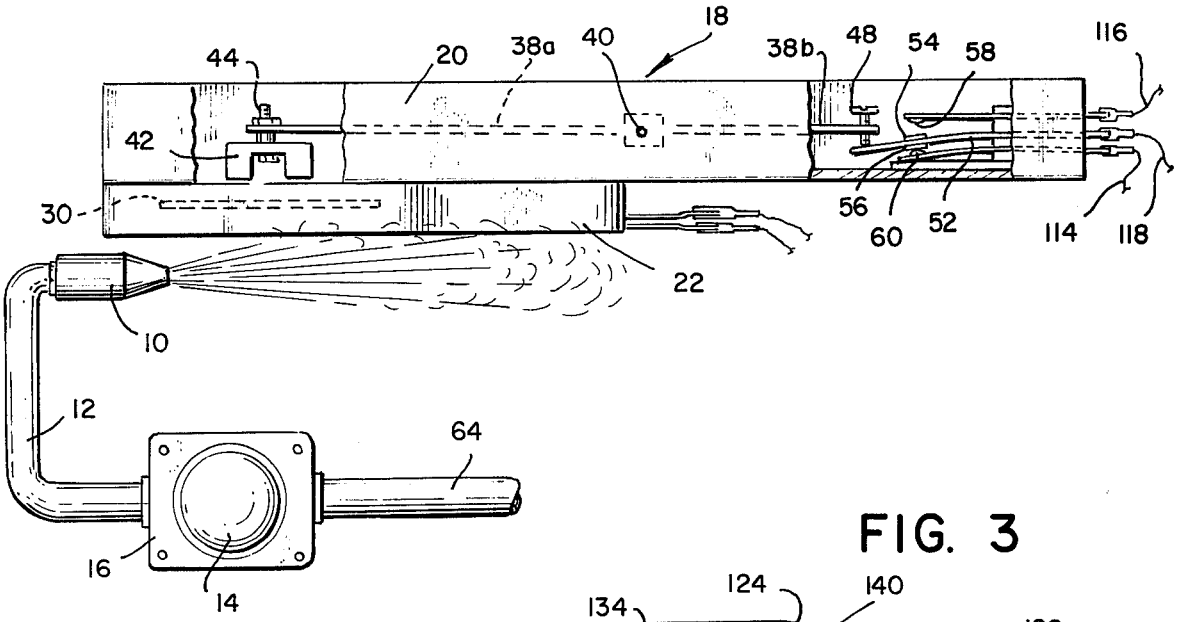
FIG. 2 is an elevational view similar to FIG. 1 but showing the system in its operative position in which gas is flowing through the burner and is ignited to produce a flame.

Referring in detail to the drawings, and particularly to FIGS. 1 and 2, there is shown the burner portion of a gas fired appliance such as a clothes dryer, kitchen range, or the like, which would normally include a gas fed pilot burner for igniting the main burner when gas is fed to the latter. The burner portion is designated generally by the reference numeral 10, and may be in the form shown for clothes dryers, in the usual circular form for cooking ranges, or in other forms. The burner 10 is fed by a pipe 12 leading to a source of gas under pressure through a gas control valve assembly 14 mounted in a housing 16.

Mounted proximate the burner 10 is an ignition and heat-sensing unit 18 made in accordance with the present invention. This ignition unit 18 includes a channel-shaped metal housing 20 affixed to the body of the appliance with its open end facing upwardly. Mounted on the bottom wall of the housing 20 is an electrically-insulated block 22 of heat resistant material. The block 22 has a recess 24 in its bottom surface, within which is mounted an electric ignition element 26. The ignition element 26 may be a bar of silicon carbide material which is heated to ignition temperature of the gas upon being electrically energized, or it may be any other suitable resistant material in plate or wire form.

The block 22 is also formed with a rectangular recess 28 which extends therethrough. Within this recess 28 is mounted a heat-sensing plate 30 in a position in which it closely overlies the ignition element 26. The plate 30 rests upon a flange 32 of block 22 which forms a ledge bordering the recess 28, and is held in position by a pair of downwardly struck legs 34 integral with the metal housing 20. The lower wall of the housing 20 has a cut-away recess 36 registering with the recess 28 of block 22, and the legs 34 are bent down at opposite ends of this recess 36.

Located within the channel of housing 20 is an elongated lever 38 which is pivotally mounted intermediate its ends by a pivot pin 40 which is journalled at its ends in the opposite side walls of the channel-shaped housing 20. At the forward end of one arm 38a of lever 38, a permanent magnet 42 is mounted by means of a screw shank 44, so that the distance by which the magnet 42 depends from the lever 38, may be adjusted.

The heat-sensing plate 30 is made of a material which, under normal room temperatures, is magnetically-attractable. The plate 30 is made of a nickel-iron alloy of the type having a Curie temperature at or above the ignition temperature of the gas in the system. A preferred material of this type is a commercially available nickel-iron alloy marketed under the trademark "INVAR 36," which has a Curie temperature of 280°C. When this alloy is heated to its Curie temperature of 280°C or above, it loses its ability to be attracted to a magnet, and thus performs the heat-sensing function to be presently described.

The permanent magnet 42 is attracted to the heat-sensing plate 30, under normal temperature, and adheres magnetically thereto, as shown in FIG. 1. A compression spring 46 is mounted between the lever arm 38*a* and the bottom wall of the housing 30 and urges the lever arm 38*a* and the magnet 42 carried thereby in a upward direction. The spring 46 is not sufficient strength, however, to cause the magnet 42 to release from the heat-sensing plate 30.

An adjustment screw 48 is mounted at the end portion of the opposite arm 38*b* of lever 38. This screw 48 engages a movable contact arm 52 of a single pole, double-throw switch 50. The contact arm 52 mounts a pair of contacts 54 and 56 and is biased in an upward direction so that the contact 54 is normally in engagement with an upper fixed contact 58 and the contact 56 is normally spaced from a lower fixed contact 60. When the magnet 42 is released from the heat-sensing plate 30, the lever 38 turns in a clockwise direction about pivot 40 under force of the spring 46, as shown in FIG. 2, causing the screw 48 to depress the movable contact arm 52 and separate contact 54 from contact 58, while bringing contact 56 into engagement with contact 60.

Figure 4:
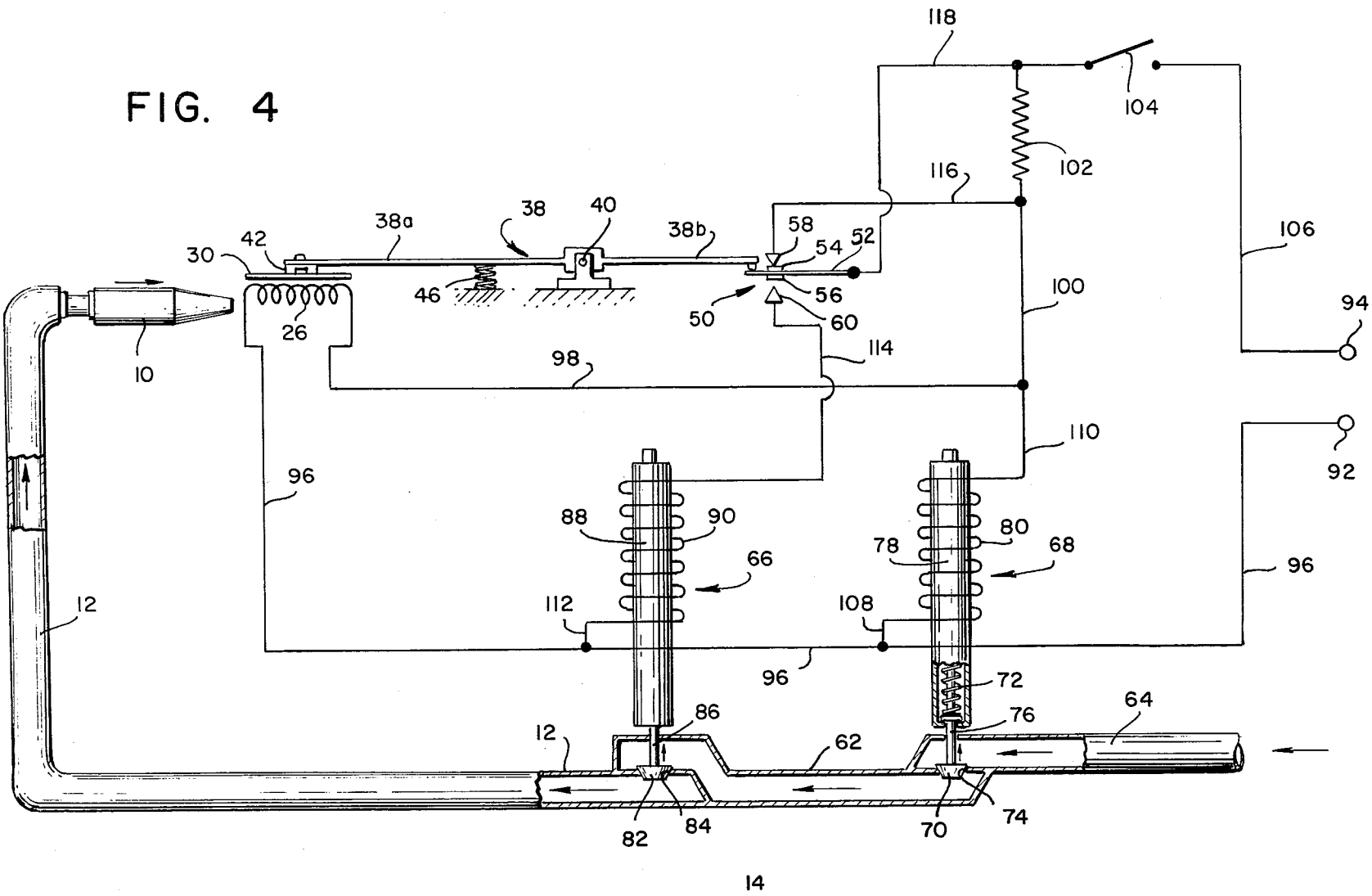
FIG. 4 is a diagrammatic view of the ignition and detection systems of FIGS. 1 and 2, showing the electrical circuitry thereof schematically.

Reference is now made to FIG. 4, which shows the ignition and heat-sensing system 18 schematically, and also shows the electrical circuit employed for automatic operation thereof. It will be seen that the gas pipe 12 communicates with a conduit 62, which in turn communicates with a gas inlet pipe 64 connected to a source of gas under pressure. The gas control valve assembly 14 is shown as including a main solenoid valve 66 and a safety solenoid valve 68. The safety solenoid valve 68 has a valve head 70 which is normally biased in a downward direction by a spring 72 so as to be seated within a valve seat 74 connecting gas inlet pipe 64 with conduit 62, and thus normally block the flow of gas from inlet pipe 64 to conduit 62. The valve head 70 is carried by a valve stem 76 which is made of a magnetically-permeable metal and is slidably mounted within a solenoid core 78 in such a manner that the stem 76 serves as an armature of the solenoid valve 68. The safety solenoid valve 68 also includes an actuating coil 80 surrounding core 78 and adapted to lift the valve stem 76 when electrically energized.

The main solenoid valve 66 is of similar construction, having a valve head 82 which is normally biased by a spring (not shown) to a seated condition in a valve seat 84 connecting the conduit 62 with burner pipe 12, and thus normally blocking the flow of gas from conduit 62 to said burner pipe 12. The valve head 82 is carried by a valve stem 86 slidably mounted within solenoid core 88 and serving as the armature of the main solenoid valve 66. The core 88 is associated with an actuating coil 90 which, when energized, lifts the valve stem 86 and thus raises the valve head 82 from its normal seated position within the valve seat 84.

The circuit shown in FIG. 2 provides means for connecting the ignition element 26 across a pair of terminals 92 and 94 of an electrical power supply source which may be a standard house power line supplying 110 volt alternating current. Specifically, one terminal of ignition element 26 is connected by lead 96 to terminal 92. The other terminal of ignition element 26 is connected by lead 98 through a resistor 102, on-off switch 104 and lead 106 to the other power supply terminal 94. The on-off switch may be a thermostat switch or a switch automatically operated by the timing mechanism of an automatic clothes drying machine or similar appliance, or may be a manually-operated switch of a cooking range.

One end of the actuating coil 80 of the safety solenoid valve 68 is connected by lead 108 to the lead 96, while the other end of coil 80 is connected by lead 110 to the lead 100. One end of the actuating coil 90 of the main solenoid valve 66 is connected by lead 112 to the lead 96, while the other end of coil 90 is connected by lead 114 to the fixed contact 60 of switch 50. The other fixed contact 58 of switch 50 is connected by lead 116 to lead 100. The movable contact arm 52 of switch 50 is connected by lead 118 through on-off switch 104 and lead 106 to the power supply terminal 94.

In operation, when the on-off switch 104 is closed by the timer, thermostat or manual means to effect ignition of the burner, a branch circuit is closed through the ignition element 26. Current thus flows from power source terminal 94 through lead 106, the closed on-off switch 104 and lead 118 to the double-throw switch 50. In this condition, the magnet 42 is attracted to the heat-sensing plate 30, and the lever 38 is in the position of FIGS. 1 and 4 in which the contacts 54 and 58 of switch 50 are in engagement. Current therefore flows through the movable switch arm 52, through closed contacts 54 and 58 and leads 116, 100 and 98 to one terminal of the ignition element 26, thence through the ignition element 26 and lead 96 to power source terminal 92, to complete the circuit. The ignition element 26 is thus energized and heated to gas-ignition temperature.

At the same time, current flows from power source terminal 94 through lead 106, closed switch 104, lead 118, closed switch contacts 54, 58 and leads 116, 100 and 110 through the actuating coil 80 of safety solenoid valve 68, and thence through leads 108 and 96 to the other power source terminal 92. The actuating coil 80 is thus energized to elevate the valve stem 76 against tension of spring 72 and lift the valve head 70 from valve seat 74. Gas thus flows from gas inlet pipe 64 into the pipe conduit 62. However, the gas cannot flow further to reach the burner 10 because the main solenoid valve 66 has not been energized and the valve head 82 remains seated in valve seat 84 to prevent gas from flowing from pipe conduit 62 to burner pipe 12.

At this initial stage, the ignition element 26 is being heated, but no gas is permitted to flow to the burner 10 until the ignition element reaches a temperature at which it will ignite the gas.

When the ignition element 26 reaches a gas ignition temperature, it heats the adjacent heat-sensing plate 30 to the same temperature, which is also the Curie temperature of the plate. As the heat-sensing plate 30 reaches its Curie temperature, it loses its ability to attract the permanent magnet 42 and thus releases the magnet. The spring 46 thus biases the lever 38 to turn about pivot pin 40 in a clockwise direction, lowering lever arm 38*b* and causing the mounted screw 48 to depress the movable switch arm 52. The contacts 54 and 58 of double-throw switch 50 are thus separated, and the contacts 56 and 60 are brought into engagement as shown in FIG. 2. This releases gas to flow to the burner 10 in the following manner:

Current now flows from power source terminal 94 through lead 106, closed on-off switch 104, lead 118, movable switch arm 52, closed contacts 56 and 60, and lead 114 through the actuating coil 90 of main solenoid valve 66, thence through lead 112 and lead 96 to the other power source terminal 92. The actuating coil 90 of main solenoid valve 66 is thus energized to lift valve head 82 from valve seat 84 and permit gas to flow from pipe conduit 62 through burner pipe 12 to the burner 10. The safety solenoid valve 68 is maintained open, since current now flows from power source terminal 94 through lead 106, closed on-off switch 104, resistor 102, leads 100 and 110 to the actuating coil 80 of safety solenoid valve 68 and thence through leads 108 and 96 to the other power source terminal 92. The resistor 102 is a current limiter for safety solenoid 68, and affords sufficient current to maintain the safety solenoid valve 68 in open condition.

Gas now flows through both open solenoid valves 66 and 68 and through pipe 12 to the burner 10. As the gas flows out of the nozzle of burner 10 it is ignited by the hot ignition element 36 to produce the desired burner flame. At this stage, the ignition element 26 is deenergized since the contacts 54 and 58 of double-throw switch 50 have been opened. This deenergization of the ignition element 36 is a desirable feature of the system once the burner has been ignited, resulting in conservation of electrical energy and also preventing damage to the ignition element through overheating.

The flame from the ignited burner 10 impinges on the heat-sensing plate 30 maintaining the latter heated to above its Curie temperature and thus maintaining switch contacts 56 and 60 in engagement so that gas continues to flow to the burner 10 and continue the burner flame until the on-off switch 104 is opened by a thermostat, timer mechanism or manual means. This opens the entire circuit, closing the solenoid valves 66 and 68, and extinguishing the burner flame. The heat-sensing plate 30 now cools to below its Curie temperature, and attracts magnet 42, causing lever 38 to pivot in a counter-clockwise direction, and thereby enabling the biased switch contact arm 52 to lift and separate contacts 56 and 60, while bringing contacts 54 and 58 into engagement. This resets the system to its starting condition.

In the event that the heated ignition element 26 should fail to ignite the gas flowing from burner 10, as, for example, by reason of a draft or low electrical current condition, or if the burner 10 is accidentally extinguished, the system will operate automatically to shut off the flow of gas to the burner. In such event, the heat-sensing plate 30, in the absence of a flame, will cool to below its Curie temperature and attract magnet 42. The lever 38 will pivot so as to elevate arm **38*b* and cause switch contacts 56 and 60 to open and deenergize the coil 90 of main solenoid valve 66. The latter now closes, and its valve head 82 enters valve seat 84 to shut off the flow of gas to burner 10. The ignition element 26 is now energized and is reheated, and gas will not flow to the burner 10 until the ignition element 26 reaches a gas ignition temperature which is sensed by the heat-sensing plate 30.**

In the event that the circuit current is interrupted for any reason, but the heat-sensing plate 30 is too hot to attract magnet 42, the current limiting resistor 102 acts as a safety means to cut off the flow of gas. In this situation, since the magnet 42 is unattracted, the switch contacts 56 and 60 remain closed and the contacts 54 and 58 are separated. When the current is resumed, the main solenoid valve 66 is opened through the engaged switch contacts 54 and 58. The safety solenoid valve 68 remains closed, however since current flows thereto only through the current limiting resistor 102. This resistor is of such value that it can maintain solenoid valve 68 open once it has been energized through the closed contacts 54, 58, but it does not permit sufficient current to the actuating coil 80 of safety solenoid valve 68 to open the latter from a closed condition.

Figure 3:
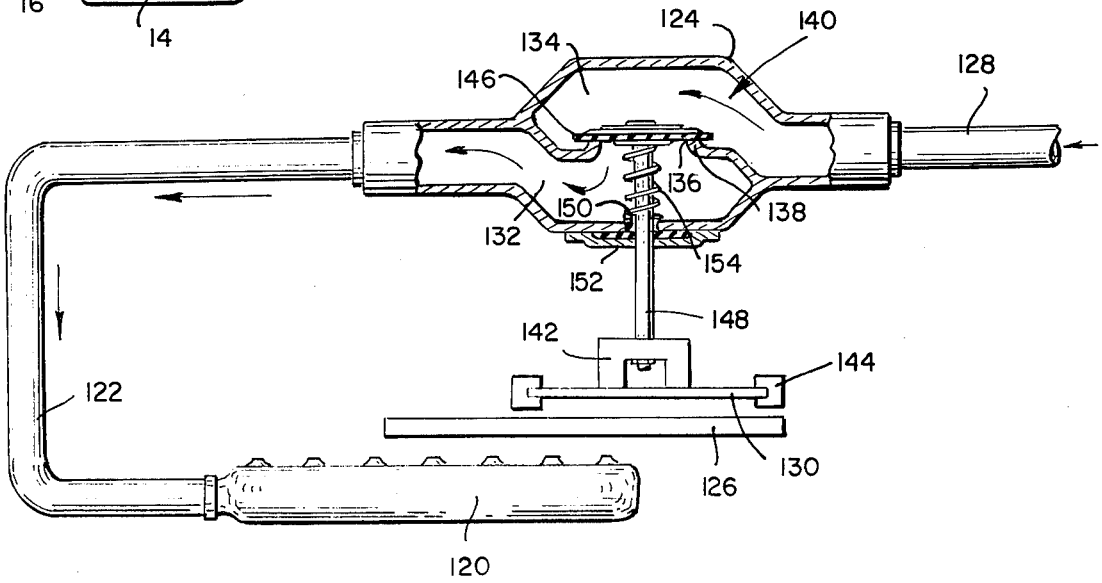
FIG. 3 is an elevational view of a gas burner installation incorporating a modified type of heat sensing and gas flow control system made in accordance with the invention, with portions thereof shown in section to disclose inner constructional details.

The embodiment of the invention described above is particularly adapted for use in automatic appliances in which the burner ignition control is automatically effected by a thermostat or timer mechanism. FIG. 3 illustrates an embodiment of control system according to the present invention which is of simplified structure and is particularly adapted for installation in a gas cooking range wherein the opening of the gas valve is performed manually.

In the embodiment of FIG. 3, the gas burner 120 (shown schematically) is connected by pipe 122 to a valve housing 124 comprising a lower chamber 132 communicating with an upper chamber 134 through an aperture 136. The aperture 136 is bordered by a valve seat 138, and is normally closed by a valve assembly 140. The valve housing 124 is fed by a gas inlet pipe 128 connected to a source of gas under pressure.

Mounted below the valve housing 124 is an electric ignition element 126 which is similar to the element 26 previously described, and when electrically energized is capable of igniting the gas flowing from the nozzle of burner 120. Mounted on a fixed support 144 immediately above the ignition element 126 is a heat-sensing plate 130 which is similar to the heat-sensing plate 30 previously described. The plate 130 is made of a nickel-iron alloy having a Curie temperature of approximately the ignition temperature of the gas, so that at normal room temperature the plate 130 will attract a magnet, but upon reaching its Curie temperature it will lose its magnetic attractability.

The valve assembly 140 includes a valve head 146 mounted on an elongated valve stem 148 which extends slidably through an aperature 150 in the lower wall of valve housing 124 and makes a wiping seal with a sealing gasket 152 bordering the aperture 150. A compression spring 154 is disposed between the valve head 146 and the lower wall of valve housing 124.

The valve head 146 is in the form of a disc of resilient material, and is sized to rest upon the valve seat 138 in the manner shown in FIG. 3 to block the flow the gas through aperture 136. A permanent magnet 142 is mounted on the bottom end of valve stem 148 and is attracted to and engages the heat-sensing plate 130. In this engaged position of the magnet 142, the valve head 146 is pressed against valve seat 138 and the flow of gas to burner 120 is blocked. The compression spring 154 urges the valve head 146 upwardly, out of its seated position, but the spring is not strong enough to pull the magnet 142 away from the heat-sensing plate 130.

In operation, when a manual control (not shown) is operated to supply gas to the inlet pipe 128 and to initiate firing of the burner 120, the ignition element 126 is energized and begins to heat. When the ignition element 126 reaches the fuel ignition temperature, it also heats the adjacent heat-sensing plate 130 to its Curie temperature, causing the element 130 to lose capacity to attract magnet 142. The heat-sensing element therefore releases magnet 142, and the compression spring 154 functions to lift the valve head 146 from valve seat 138, so that gas flows to burner 120.

As the gas flows from the mouth of burner 120, it is ignited by the ignition element 126 to produce the desired flame. The burner is so located that the flame heats the heat-sensing plate 130 and maintains it at its Curie temperature, so that the gas valve 140 remains open. Conventional timer means (not shown) may be provided to deenergize the ignition element 126 after a short period so that the element does not continue to heat after the burner is fired. When the cooking operation is completed, the user may turn off the flame in the usual manner by operation of the manual control which shuts off the flow of gas through inlet pipe 128.

It will be seen that in both of the aforementioned embodiments, no gas is permitted to flow to the burner until an ignition temperature is attained, which is a desirable safety feature in systems of this type. The heat-sensing element has a fixed value and is extremely sensitive and accurate, while at the same time the structure of the ignition and sensing unit is simple, compact and sturdy, and the unit may be installed in areas of high ambient temperatures where other devices cannot function.

While preferred embodiments of the invention have been shown and described herein, it is obvious that numerous omissions, changes and additions may be made in such embodiments without departing from the spirit and scope of the invention.

What is claimed is:

1. An automatic fuel ignition and detection system for gas fired devices having a source of electrical power, a burner provided with an outlet, and a fuel valve for controlling the flow of gas into said burner, said system comprising an electrical ignition element connected to said source of electrical power and located in proximity to said burner outlet for igniting gas flowing thereto when said ignition element is energized and brought to a gas ignition temperature, a heat-sensing element mounted adjacent to said ignition element in a position to receive the heat therefrom, said heat-sensing element being normally magnetically attractable and having a Curie temperature at least as high as said gas ignition temperature at which it loses its magnetic attractability, a permanent magnet positioned to be attracted to and engaged by said heat-sensing element when the temperature of the latter is below its Curie temperature, said magnet being released by said heat-sensing element when the latter is heated to its Curie temperature, biasing means urging said magnet in a direction away from said heat-sensing element, and means operatively connecting said magnet to said fuel valve for closing said fuel valve when said magnet is in engagement with said heat-sensing element, and opening said fuel valve when said magnet is released by said heat-sensing element and moved out of engagement therewith by said biasing means, whereby gas is fed through said burner only after said ignition element has been heated to said gas ignition temperature.

2. A system according to claim 1 in which said heat-sensing element is formed of a nickel-iron alloy having a Curie temperature of above 250°C.

3. A system according to claim 1 which also includes means for deenergizing said ignition element after said burner is ignited, and in which said heat-sensing element is positioned adjacent said burner outlet in a position to be heated by the flame emitted from said burner, whereby said fuel valve is maintained open after said ignition element is deenergized.

4. A system according to claim 1 which also includes electrical switch and circuit means connecting said ignition element to said electrical power source through said switch means, said switch means having a first position in which said ignition element is connected to said electrical power source for energization of said ignition element, and a second position in which said ignition element is disconnected from said power source, said coupling means including means operatively connecting said magnet to said switch means for bringing said switch means to its first position when said magnet is in engagement with said heat-sensing element, and bringing said switch means to its second position when said magnet is biased out of engagement with said heat-sensing element.

5. A system according to claim 4 in which said fuel valve is a normally closed electromagnetic fuel valve including a solenoid for opening said valve and having an actuating coil, said system also including circuit means connecting said actuating coil to said electrical power source through said switch means, said switch means in said second position connecting said actuating coil to said power source for energization of said solenoid and opening of said fuel valve to feed gas to said burner, said switch in said first position disconnecting said actuating coil from said power source to close said fuel valve.

6. A system according to claim 5 which also includes a second fuel valve for controlling the flow of gas to said burner and located in series with said first fuel valve, and a second solenoid for opening said second fuel valve and having an actuating coil, said system also including an energizing circuit connecting the actuating coil of said second solenoid to said electrical power source through said switch means whereby said second fuel valve is opened when said switch means is in its first position.

7. A system according to claim 6 which also includes resistance means and a holding circuit connecting the actuating coil of said second solenoid directly to said power source through resistance means, said resistance means having a value sufficient to hold said second fuel valve in open condition after said switch means is brought to its second position and said energizing circuit is opened.

8. A system according to claim 4 in which said switch means comprises a double-throw switch having a contact arm movable between the first and second positions of said switch means.

9. A system according to claim 8 which includes an elongated lever pivotally mounted intermediate its ends, said magnet being mounted on one end of said lever, the other end of said lever engaging the contact arm of said switch.

* * * * *